US009656398B2

(12) United States Patent
Wang

(10) Patent No.: US 9,656,398 B2
(45) Date of Patent: May 23, 2017

(54) UTILITY KNIFE

(75) Inventor: Aiguo Wang, Xidian (CN)

(73) Assignee: Zhejiang Xingda Stationary Co., Ltd., Xidian Town (CN)

( * ) Notice: Subject to any disclaimer, the term of this patent is extended or adjusted under 35 U.S.C. 154(b) by 242 days.

(21) Appl. No.: 14/389,234

(22) PCT Filed: Jul. 3, 2012

(86) PCT No.: PCT/CN2012/000910

§ 371 (c)(1),
(2), (4) Date: Sep. 29, 2014

(87) PCT Pub. No.: WO2013/163783

PCT Pub. Date: Nov. 7, 2013

(65) Prior Publication Data

US 2015/0082641 A1 Mar. 26, 2015

(30) Foreign Application Priority Data

May 3, 2012 (CN) ..... 2012 1 0134896

(51) Int. Cl.
*B26B 5/00* (2006.01)
*B26B 1/08* (2006.01)

(52) U.S. Cl.
CPC ..... *B26B 5/001* (2013.01); *B26B 1/08* (2013.01)

(58) Field of Classification Search
CPC ..... B26B 1/08
USPC ..... 30/162, 151, 152
See application file for complete search history.

(56) References Cited

U.S. PATENT DOCUMENTS 5,337,481 A * 8/1994 Mears ..... B26B 5/008 30/162
6,330,749 B1 * 12/2001 Khachatoorian ..... B26B 5/001 30/125
6,374,497 B1 * 4/2002 Sun ..... B26B 5/001 30/125
2003/0196331 A1 * 10/2003 Ho ..... B26B 5/001 30/162
2007/0220758 A1 * 9/2007 Ho ..... B26B 5/001 30/162
2009/0223063 A1 * 9/2009 Hallquist ..... B26B 5/001 30/162
2012/0042523 A1 * 2/2012 Strauss ..... B26B 5/001 30/162

FOREIGN PATENT DOCUMENTS

CA 2683881 A1 * 5/2010 ..... B26B 5/001

* cited by examiner

*Primary Examiner* — Omar Flores Sanchez
(74) *Attorney, Agent, or Firm* — Wang Law Firm, Inc.

(57) ABSTRACT

A utility knife including a housing (19), two parallel knife holders slidingly disposed substantially parallel to each other inside the front section of the housing; different blades (5) are positioned on the two knife holders; each push button (6) is movably disposed on top of one knife holder (3); a strip-shaped aperture (17) is provided on top of the inner wall of the housing (19); the strip-shaped aperture has two grooves (1*e*), parallel to each other, for receiving the two push buttons and for allowing the two push buttons (6) to slide along the two parallel grooves; and a plurality of recesses (1*a*) are distributed inside each groove; each push button further comprises a snap block (61), when the snap block (61) is inserted into the corresponding recess (1*a*), the corresponding knife holder (3) and the blade (5) are locked in position.

7 Claims, 5 Drawing Sheets

UTILITY KNIFE

RELATE APPLICATIONS

This application is a national phase entrance of and claims benefit to PCT Application for a utility knife, PCT/CN2012/000910, filed on Jul. 3, 2012, which claims benefit to Chinese Patent Application 201210134896.3, filed on May 3, 2012. The specifications of both applications are incorporated herein by this reference.

FIELD OF THE INVENTION

The present invention relates to a kind of a utility knife.

DESCRIPTION OF THE PRIOR ART

As one of common hand tools, utility knives are often used for cutting paper, leather, plastic sheets, hardboards or the like. There have been many types of utility cutters at present. For the convenience of replacement of blades, there are many utility knives with spare blades raised in the market. For example, a Chinese Patent (Patent No.: ZL200920117976.1), titled "UTILITY KNIFE WITH AUTOMATIC BLADE REPLACEMENT FUNCTION", disclosed a utility knife comprising a housing and blades; a magnetic pushing block, capable of sliding in the axis of the housing, is provided in the housing, a blade storage chamber fitted with the blades in shape is vertically disposed in the housing, and the magnetic pushing block serves as the bottom surface of the blade storage chamber; the housing has a head section with an opening; a push button extending upward is disposed on the magnetic pushing block, a groove is formed along the length of the housing, the push button is disposed inside the groove, a transversal turning groove is formed on the front end of the groove, and the extension direction of the turning groove faces away from the blade storage chamber. When in use, a blade is attracted onto the magnetic pushing block, then push the push button to make the magnetic pushing block move forward, meanwhile, to drive the blade attracted onto the magnetic pushing block forward, so that the blade is pushed out from the opening. When the push button is pushed to the foremost end of the groove, the push button is pulled into the turning groove, then the magnetic pushing block rotates to a certain extent, and the blade may be thus taken off. Although the blade may be replaced quickly in such a structure, like the majority of utility knives in the market, this utility knife ensures the use of only one blade. This utility knife has a small scope of application and has no shift function. As a result, different types of blades cannot be used as required; furthermore, positioning cannot be performed according to the extension length requirement of the blade. Therefore, this utility knife needs to be further improved.

SUMMARY OF THE INVENTION

It is an object of the present invention to provide a utility knife having safety in use and a double-blade switch. By this utility knife, different types of blades can be used as required; furthermore, positioning can be performed according to the extension length requirement of the blade.

For achieving the above stated object, the utility knife comprises a housing, formed by an upper cover and a base, having an inner wall and a head section with an opening for blades to slide in and out of the housing; two knife holders slidingly disposed substantially parallel to each other inside the front section of the housing; different of blades positioned on the two knife holders, one blade on each knife holder; a knife holder gasket with a top edge, disposed between the two knife holders; and two push buttons, each push button movably disposed on top of one knife holder; wherein a strip-shaped aperture is provided on top of the inner wall of the housing at a position corresponding to the top edge of the knife holder gasket, the strip-shaped aperture has two grooves, parallel to each other, for receiving the two push buttons and for allowing the two push buttons to slide along the two parallel grooves, and a plurality of recesses distributed inside each groove for positioning the corresponding push button, each push button further comprises a snap block for inserting into the corresponding recess, each push button can drive the corresponding knife holder and the blade forward and backward along the corresponding groove, and when the snap block is inserted into the corresponding recess, the corresponding knife holder and the blade are locked in position.

Preferably, the knife holders are magnetic knife holders and each knife holder has an internal side surface and an external side surface, the magnetic knife holders are respectively attracted to two sides of the knife holder gasket through magnetism, the knife holder gasket is positioned on the base, and has a front surface aligned with the opening of the head section of the housing, the top edge is folded toward two side surfaces of the knife holder gasket, the two parallel grooves are formed between the top edge and the inner wall of the housing; each magnetic knife holder has an external side surface formed with a blade suction groove for holding a blade and an internal side surface with a transversal protrusion, each side surface of the knife holder gasket is formed with a guiding groove for receiving the corresponding transversal protrusion of the magnetic knife holder, the magnetic knife holders are slidably connected to the knife holder gasket when each transversal protrusion is inserted into the corresponding guiding groove.

Preferably, each magnetic knife holder has a rear portion with an inserting hole defined on top of the rear portion for receiving the corresponding push button, each push button has a bottom, an external side surface, and an internal side surface, a return spring is supported between the corresponding inserting hole and the bottom of the push button, the internal side surface of the push button is formed with a bulge resisting against the top edge of the knife holder gasket, the snap block for inserting into the corresponding recess is provided on the external side surface of each push button.

Preferably, each blade has a top, at least one gap is provided on the top of each blade, the internal side surface of each magnetic knife holder has a locking block, corresponding to a position of the at least one gap, for locking the at least one gap, each locking block has a front portion, a rear portion and a rear end, the front portion of the locking block is formed with a flange for engaging with the at least one gap, the flange passes through a notch on the corresponding magnetic knife holder to lock in the at least one gap, the rear portion of the locking block is provided with a circular hole, the internal side surface of each magnetic knife holder is formed with a circular column, the flange engages the corresponding magnetic knife holder when the circular hole receives the circular column of the corresponding magnetic knife holder, a projection is formed above the circular hole of the locking block, a spring is supported between the rear end of the corresponding locking block and the magnetic knife holder, two slope lugs are respectively formed on top of inner sides of the base and the upper cover, when each push button is pushed to a foremost end of the corresponding groove, each slope lug resists against the projection of the corresponding locking block, and the locking block rotates upward against the spring, so that the flange is separated from the at least one gap of the corresponding blade.

Preferably, a spare knife holder for holding spare blades is disposed inside a rear section of the housing, the spare knife holder has a front portion, a rear portion and a bottom, two columns are formed on two side surfaces of the front portion of the spare knife holder, one column on each side surface, one elastic buckle is formed on each side surface of the rear portion of the spare knife holder, a bottom of a rear portion of the housing is provided with an arc openings, the inner wall of the housing is provided with two connecting holes for receiving the two columns, two positioning recesses for receiving the two elastic buckles, the spare knife holder is rotatably disposed inside the rear portion of the housing and is capable of rotating out from the bottom of the housing.

Preferably, the spare knife holder is made from plastic, the bottom of the spare knife holder has an arc-shape for engaging the housing, a spare blade groove and a elastic buckle for fixing the spare blades are disposed inside the spare knife holder, bottoms of rear portions of the base and the upper cover are respectively formed with an arc opening, a top end of each elastic buckle has an arc projection for matching the corresponding arc opening, the arc projections are inserted into the corresponding arc opening of the base and the upper cover by size fitting, and the positioning recesses of the base and the upper cover respectively receives the corresponding elastic buckle and the elastic buckles are positioned.

Preferably, a connecting column with an inner hole is formed a center of the inner wall of the housing, a corresponding through hole is provided on a rear portion of the knife holder gasket, and a corresponding sink hole is provided on the upper cover, the through hole of the knife holder gasket is sleeved on the connecting column, a connecting screw passes through the sink hole of the upper cover and screws into an inner hole of the connecting column of the base to connect the upper cover, the knife holder gasket and the base.

Preferably, the base has a tail end, a small connecting column is provided on a bottom of the tail end of the base, the upper cover has a tail end, a small sink hole is provided on the tail end of the upper cover, the small connecting column and the small sink hole is connected with a screw, a hanging hole for hanging the utility knife is formed on a top of a tail end of the housing when the base and the upper cover are mounted together.

Preferably, there are three to four recesses, which are respectively located along the top of the inner walls of the housing and the upper cover, that is, the two inner side walls of the strip-shaped aperture.

Preferably, the bottom of the knife holder gasket is provided with an elastic strap with a clamp matching with the knife holders.

Finally, bicolor upper cover package plastic and bicolor upper cover package rubber are coated on the outside of the upper cover, and bicolor base package plastic and bicolor base package rubber are coated on the outside of the base.

Compared with the prior art, in the present invention, as there are two knife holders and blades, different blades may be used according to different requirements, so that the application scope of the utility knife is expanded greatly; meanwhile, the utility knife is safe in use and convenient in operation. The knife holder may be driven to slide forward as long as the corresponding push button is pressed down and pushed forward, and the blade attracted onto the corresponding knife holder is also extended out from the housing along with the knife holder; moreover, positioning may be performed, and a spare knife holder is provided so that the blades may be replaced in time. The utility knife with a nice appearance is safe in use and convenient in operation, and also has spare blades and a double-blade function, different blades may be used as required and quick blade replacement and positioning may be realized. The utility knife is reasonable and practical in structure.

DETAILED DESCRIPTION OF THE PREFERRED EMBODIMENT

Figure 1:
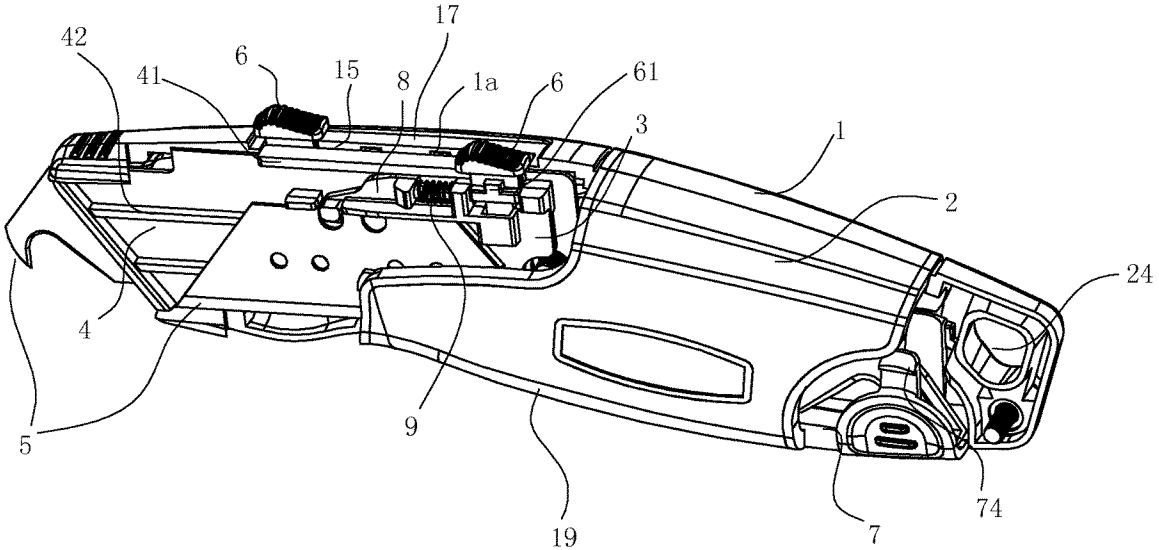
FIG. 1 is a perspective view of a utility knife according to an embodiment of the present invention, when a part of the cover is moved.
Figure 2:
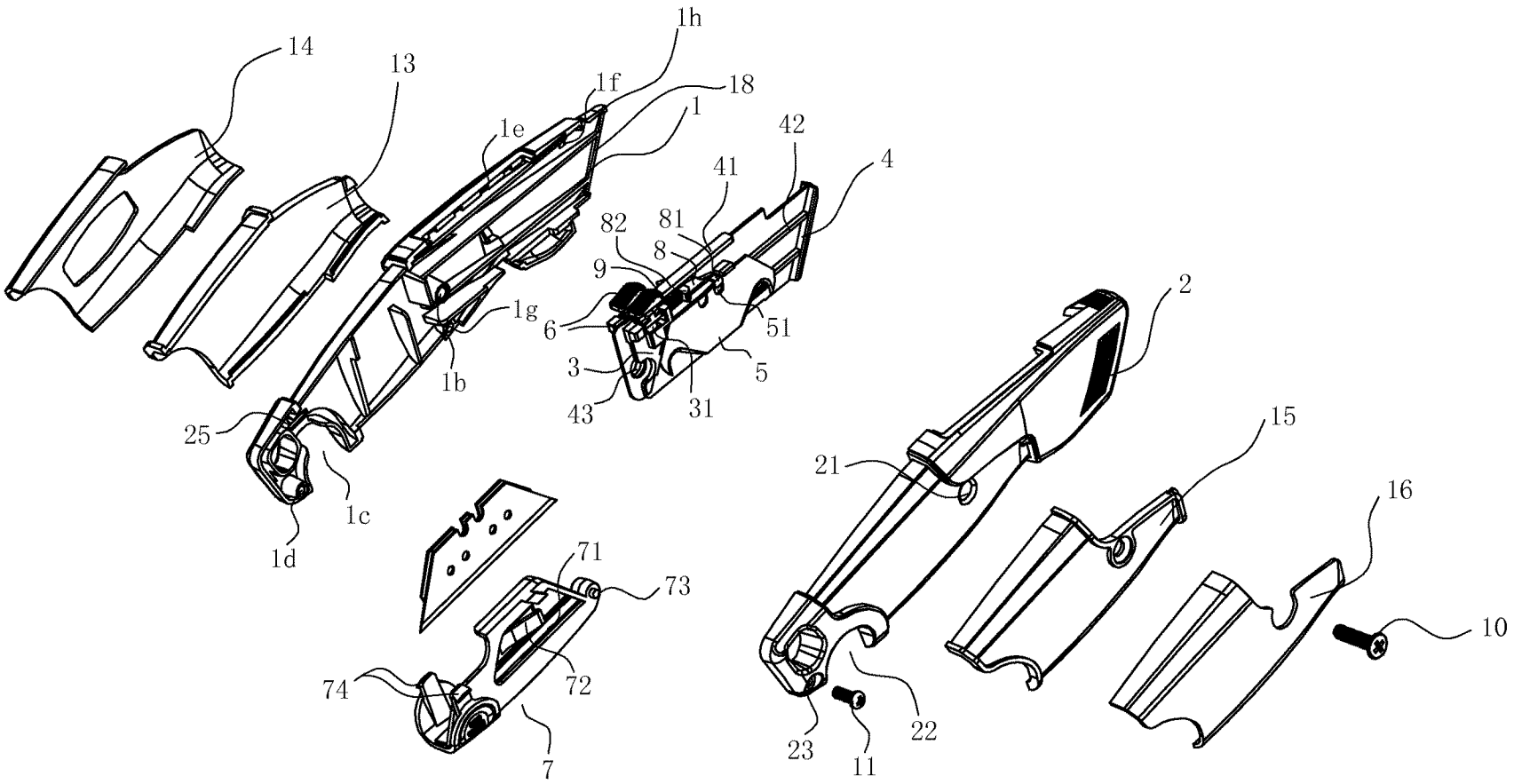
FIG. 2 is an exploded perspective view of the utility knife according to the embodiment of the present invention.
Figure 3:
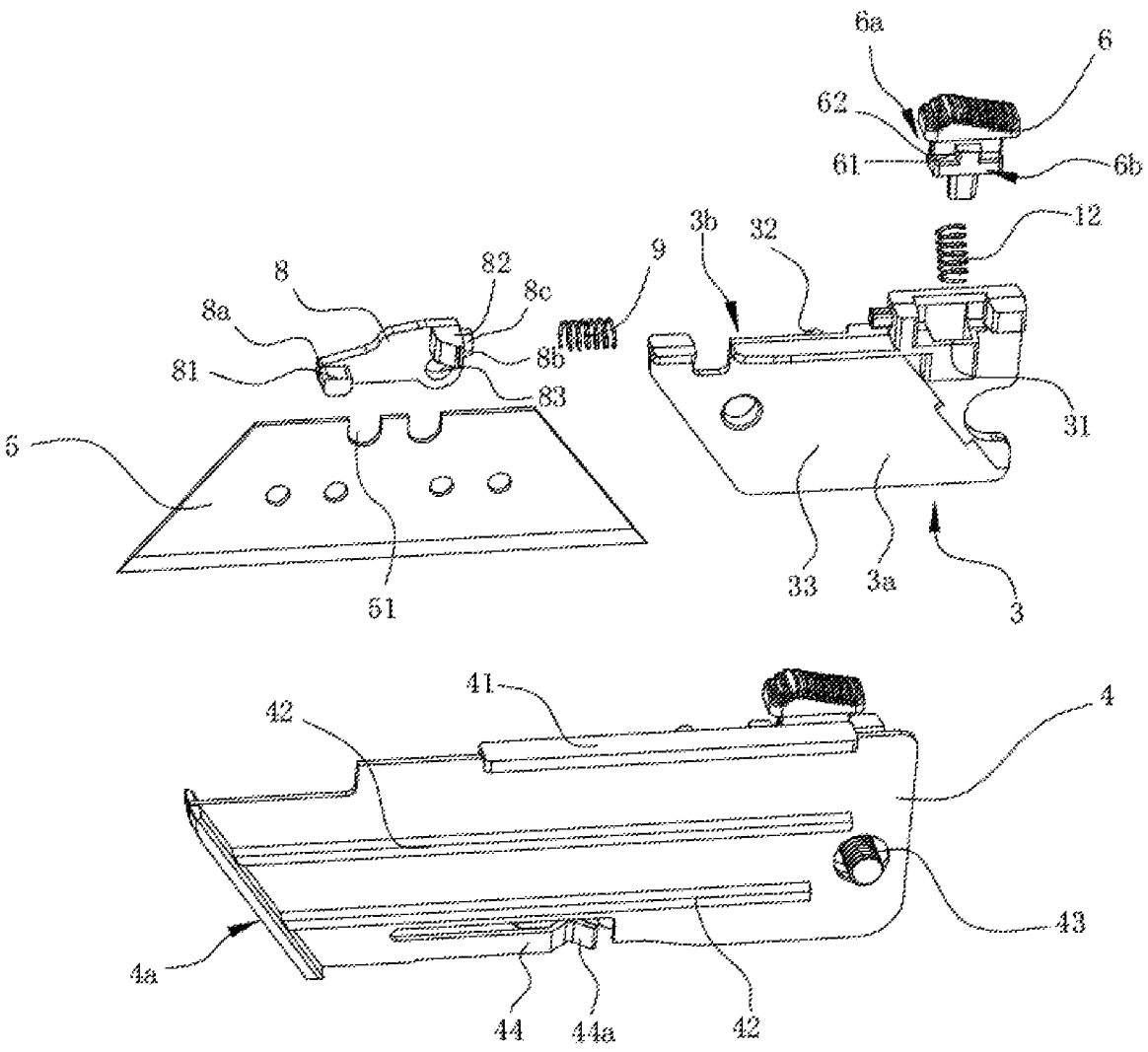
FIG. 3 is an exploded partial perspective view of the utility knife according to the embodiment of the present invention.
Figure 4:
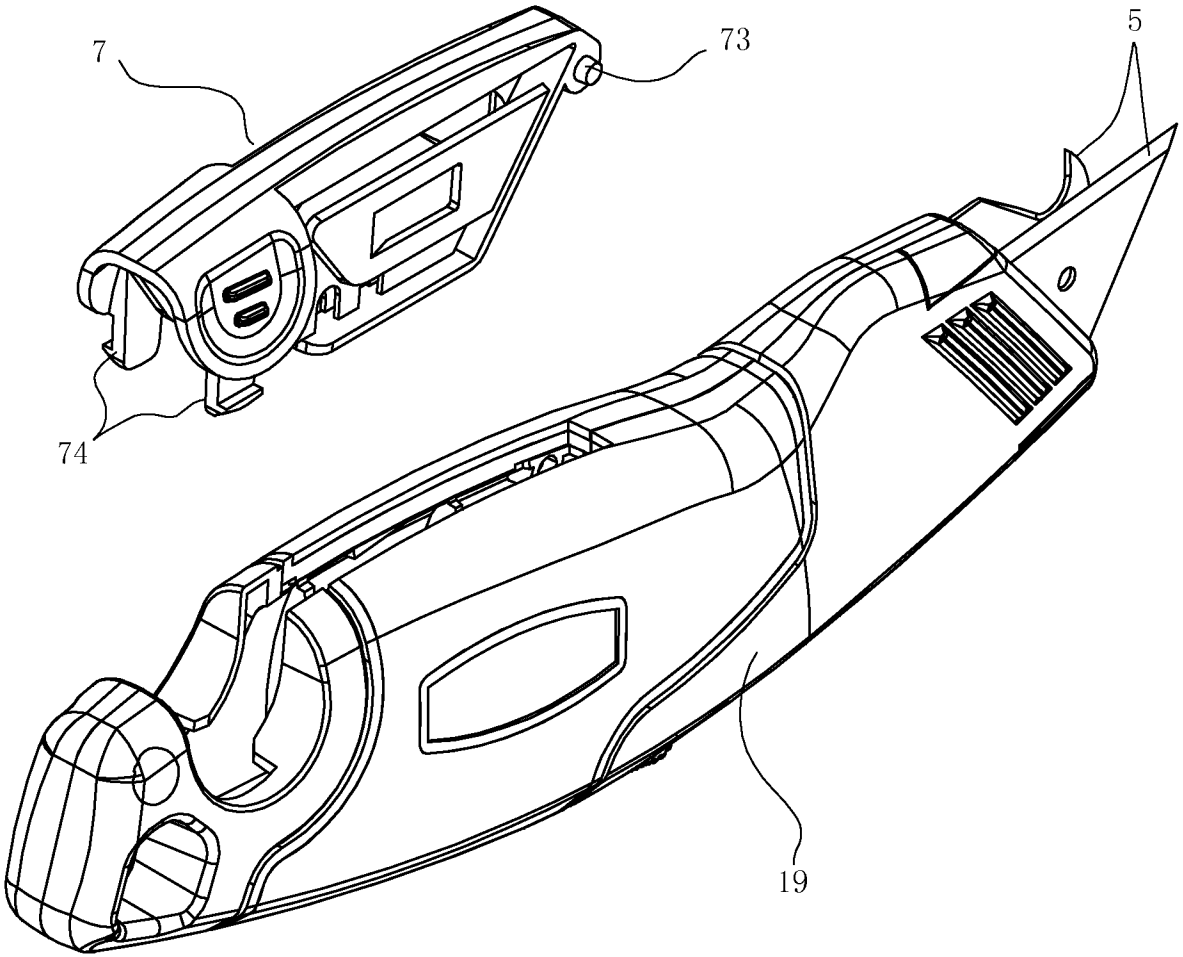
FIG. 4 is an exploded perspective view of the utility knife according to the embodiment of the present invention showing the spare knife holder mounted onto the housing.
Figure 5:
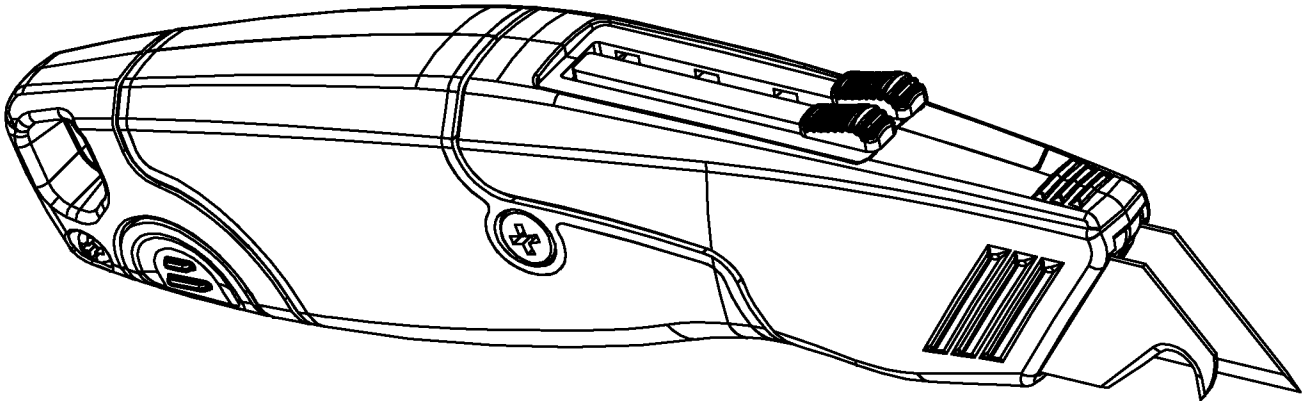
FIG. 5 is a perspective view of the utility knife according to the embodiment of the present invention showing the appearance of the utility knife.

To enable a further understanding of the innovative and technological content of the invention herein refer to the detailed description of the invention and the accompanying drawings below:

As shown in FIGS. 1 to 5, the utility knife comprises a housing 19, a knife holder gasket 4 disposed in the housing, two knife holders 3, two blades 5, two push buttons 6, a spare knife holder 7 and other main components.

The housing 19 is formed by an upper cover 2 and a base 1, which are made by aluminum die casting; after the upper cover 2 and the base 1 are mounted together, the housing has a head section with an opening 18 for blades to slide in and out of the housing; a strip-shaped aperture 17 is provided on top of the inner wall of the housing 19, four recesses 1*a* are respectively distributed inside two inner side wall of the strip-shaped aperture 17, that is, the top of the inner walls of the base 1 and upper cover 2; the knife holder gasket 4, made of stainless steel as liner and externally coated with package plastic, is disposed between the two knife holders 3 of the front section of the housing 19; the knife holder gasket 4 is positioned on the base 1, and has a front surface 4*a* aligned with the opening 18 of the head section of the housing 19, clearances are reserved for allowing the blades 5 at two sides of the knife holder gasket 4 to extend outside of the housing 19; a top edge 41 is folded toward two side surfaces of the knife holder gasket 4 and is disposed inside the middle of the strip-shaped aperture 17, two parallel grooves 1*e* are formed between the top edge 41 and the inner wall of the strip-shaped aperture 17; the knife holders 3 are magnetic knife holders, the magnetic knife holders 3 are respectively attracted to two sides of the knife holder gasket 4 through magnetism, each magnetic knife holder 3 has an external side surface 3*a* formed with a blade suction groove 33 for holding a blade and an internal side surface 3*b* with a transversal protrusion, each side surface of the knife holder gasket 4 is formed with a guiding groove 42 for receiving the corresponding transversal protrusion of the magnetic knife holder, the magnetic knife holders 3 are slidably connected to the knife holder gasket 4 when each transversal protrusion is inserted into the corresponding guiding groove 42; the bottom of the knife holder gasket 4 is provided with an elastic strap 44 with a clamp 44*a* matching with the knife holders 3, the elastic strap 44 is formed by grooving on the knife holder gasket 4, the clamp 44*a* is in V-shaped protruding outward, such a configuration is simple and has protective effects, when any one of the two knife holders is in use, the protruded clamp of the elastic strap 44 will be triggered to pop up towards the other side and cannot return to the original position, so that the other knife holder cannot be pushed out; each magnetic knife holder 3 has a rear portion with an inserting hole 31 defined on top of the rear portion for receiving the corresponding push button 6, each push button 6 is slidably along the corresponding groove 1*e*; each push button 6 has a bottom, an external side surface 6*b*, and an internal side surface 6*a*, the bottom of each push button 6 is inserted into the inserting hole 31, a return spring 12 is supported between the corresponding inserting hole 31 and the bottom of the push button 6, the internal side surface 6*a* of the push button 6 is formed with a bulge 62 resisting against the top edge 41 of the knife holder gasket 4, the snap block 61 for inserting into the corresponding recess is provided on the external side surface 6*b* of each push button 6, thus, each push button 6 can drive the corresponding knife holder 3 and the blade 5 forward and backward along the corresponding groove 1*e*, and when the snap block 61 is inserted into the corresponding recess 1*a*, the corresponding knife holder 3 and the blade 5 are locked in position.

There are two blades 5, one is a common blade, while the other is a blade with an elbow, which are respectively attacked on the corresponding blade suction groove 33 of two knife holders 3; each blade 5 has a top, two gaps 51 are provided on the top of each blade 5, the internal side surface of each magnetic knife holder 3 has a locking block 8, corresponding to a position of the gaps 51, for locking the gaps 51, each locking block 8 has a front portion 8*a*, a rear portion 8*b* and a rear end 8*c*, the front portion 8*a* of the locking block 8 is formed with a flange 81 for engaging with the gaps 51, the flange 81 passes through a notch on the corresponding magnetic knife holder 3 to lock in the gaps 51, the rear portion 8*b* of the locking block 8 is provided with a circular hole 83, the internal side surface 3*b* of each magnetic knife holder 3 is formed with a circular column 32, the flange 8 rotatably engages the corresponding magnetic knife holder 3 when the circular hole 83 receives the circular column 32 of the corresponding magnetic knife holder 3, and the flange 8 is attracted to the corresponding to the internal side surface 3*b* of each magnetic knife holder 3 through magnetism, a projection 82 with a inclined surface is formed above the circular hole 83 of the locking block 8; a spring 9 is supported between the rear end of the corresponding locking block 8 and the magnetic knife holder 3, so that the locking block 8 always has a trend of rotating downward to be locked with the gaps 51 of the corresponding blade 5, the front end of each projection 82 is formed with a inclined surface; two slope lugs if are respectively formed on top of inner sides of the base 1 and the upper cover 2, when each push button 6 is pressed and pushed to a foremost end of the corresponding groove 1*e*, each slope lug if resists against the projection 82 of the corresponding locking block 8, and the locking block 8 rotates upward against the spring 9, so that the flange 81 is separated from the gaps 51 of the corresponding blade 5 for replacing the blade 5.

A spare knife holder 7 for holding spare blades is disposed inside a rear section of the housing 19, the spare knife holder 7 has a front portion, a rear portion and a bottom, the spare knife holder 7 is made from plastic, the bottom of the spare knife holder 7 has an arc-shape for engaging the housing 19, a spare blade groove 71 and a elastic buckle 72 for fixing the spare blades are disposed inside the spare knife holder 7; two columns 73 are formed on two side surfaces of the front portion of the spare knife holder 7, one column on each side surface, one elastic buckle 74 is formed on each side surface of the rear portion of the spare knife holder 7; the inner wall of the base 1 and the upper cover 2 are respectively provided with a connecting hole 1*g* for receiving the corresponding column 73 and a positioning recess 25 for receiving the corresponding elastic buckle 74, bottom of rear portion of the base 1 is formed with an arc opening 1*c* and bottom of rear portion of the upper cover 2 is formed with an arc opening 22, a top end of each elastic buckle 74 has an arc projection for respectively matching the arc opening 1*c* and the arc opening 22, the arc projections are respectively inserted into the arc opening 1*c* of the base 1 and the arc opening 22 of the upper cover 2 by size fitting; the spare knife holder 7 can be engaged with the bottom of the housing or separated from the bottom of the housing by fitting of the positioning recesses 25 of the base 1 and the upper cover 2 with the corresponding elastic buckle 74, the spare knife holder 7 can be rotated by fitting of the columns 73 respectively with the connecting holes 1*g* of the base 1 and the upper cover 2, thus, when it is need to take the spare blade out, the elastic buckles 74 are separated from the housing as long as the arc projections at the end of the spare knife holder 7 is pressed by hands, so that the spare knife holder 7 may rotate out from the bottom of the housing, and the spare blade may be taken out. After use, the spare knife holder 7 is rotated upward, and then inserted into the bottom of the housing for positioning.

Top and bottom of the front end of the base 1 are respectively formed with a 7-shaped lugs 1*h*, while Top and bottom of the front end of the upper cover 2 are respectively formed with a 7-shaped grooves engaged with the corresponding 7-shaped lug 1*h*, so that this utility knife becomes beautiful and firm after the base and the upper cover are mounted together; a connecting column 1*b* with an inner hole is formed a center of the inner wall of the housing, a corresponding through hole 43 is provided on a rear portion of the knife holder gasket 4, the through hole 43 of the knife holder gasket 4 is sleeved on the connecting column 1*b*; and a corresponding sink hole 21 is provided on the upper cover 2, a connecting screw 10 passes through the sink hole 21 of the upper cover 2 and screws into an inner hole of the connecting column 1*b* of the base 1 to connect the upper cover 2, the knife holder gasket 4 and the base 1; the base 1 has a tail end, a small connecting column 1*d* is provided on a bottom of the tail end of the base 1, the upper cover 2 has a tail end, a small sink hole 23 is provided on the tail end of the upper cover 2, the small connecting column 1*d* and the small sink hole 23 is connected with a screw 11, a hanging hole 24 for hanging the utility knife is formed on a top of a tail end of the housing when the base 1 and the upper cover 2 are mounted together; the upper cover 2 is covered with a bicolor upper cover package plastic 15 and a bicolor upper cover package rubber 16, and the base 1 is covered with a bicolor base package plastic 13 and a bicolor base package rubber 14, which is beautiful on appearance and is comfortable to hold when the utility knife is in use.

When in use, it is just needed to press down and push forward one push button 6 to drive the corresponding knife holder 3 to slide forward, and the blade 5 attracted onto this knife holder 3 also slides forward and extends out from the housing 19. When the push button 6 slides to a position where the recess 1*a* is distributed, the press to the push buttons 6 is released, so that the snap block 61 on the push button is inserted into the corresponding recess 1*a* for positioning, and the push button may be positioned according to the requirement of the extension length of the blade 5. Moreover, when any one of the two knife holders is pushed out for use, the raised clamp of the elastic strap 44 is triggered to pop up towards the other side so as to stop the other knife holder to push out. Different blades 5 may be used as required, when the blades 5 need to be replaced, the push button 6 is pressed down and pushed forward to the foremost end of the corresponding groove 1*e*, the slope lug 1*f* is rightly resisted against the projection 82 of the corresponding locking block 8, and the locking block 8 rotates upward against the spring 9, so that the flange 81 is separated from the gap 51 of the corresponding blade 5, and the blade 5 is unlocked to be taken off easily or a new blade may be replaced; then, release the button 6 and the locking block 8 locks the blade 5 again. Press the arc projections of the end of the spare knife holder 7 to make the elastic buckles 74 are separated from the housing, so that the spare blade is taken off; after the spare blade is taken off, the spare knife holder 7 is rotated upward and buckled with the housing; in this way, the blades 5 may be replaced quickly.

The invention claimed is:

1. A utility knife comprising:

a housing, formed by an upper cover and a base, having an inner wall and a head section with an opening for blades to slide in and out of the housing;

two knife holders slidingly disposed substantially parallel to each other inside the front section of the housing;

blades positioned on the two knife holders, one blade on each knife holder;

a knife holder gasket with a top edge, disposed between the two knife holders; and two push buttons, each push button movably disposed on top of one knife holder;

wherein a strip-shaped aperture is provided on top of the inner wall of the housing at a position corresponding to the top edge of the knife holder gasket, the strip-shaped aperture has two grooves, parallel to each other, for receiving the two push buttons and for allowing the two push buttons to slide along the two parallel grooves, and a plurality of recesses distributed inside each groove for positioning the corresponding push button, each push button further comprises a snap block for inserting into the corresponding recess, each push button can drive the corresponding knife holder and the blade forward and backward along the corresponding groove, and when the snap block is inserted into the corresponding recess, the corresponding knife holder and the blade are locked in position;

the knife holders are magnetic knife holders and each knife holder has an internal side surface and an external side surface, the magnetic knife holders respectively attract to two sides of the knife holder gasket through magnetism, the knife holder gasket is positioned on the base, and has a front surface aligned with the opening of the head section of the housing, the top edge is folded toward two side surfaces of the knife holder gasket, the two parallel grooves are formed between the top edge and the inner wall of the housing; each magnetic knife holder has the external side surface formed with a blade suction groove for holding a blade and the internal side surface, each side surface of the knife holder gasket is formed with a guiding groove, the magnetic knife holders are slidably connected to the knife holder gasket;

each magnetic knife holder has a rear portion with an inserting hole defined on top of the rear portion for receiving the corresponding push button, each push button has a bottom, an external side surface, and an internal side surface, a return spring is supported between the corresponding inserting hole and the bottom of the push button, the internal side surface of the push button is formed with a bulge resisting against the top edge of the knife holder gasket, the snap block for inserting into the corresponding recess is provided on the external side surface of each push button; and each blade has a top, at least one gap is provided on the top of each blade, the internal side surface of each magnetic knife holder has a locking block, corresponding to a position of the at least one gap, for locking the at least one gap, each locking block has a front portion, a rear portion and a rear end, the front portion of the locking block is formed with a flange for engaging with the at least one gap, the flange passes through a notch on the corresponding magnetic knife holder to lock in the at least one gap, the rear portion of the locking block is provided with a circular hole, the internal side surface of each magnetic knife holder is formed with a circular column, the flange engages the corresponding magnetic knife holder when the circular hole receives the circular column of the corresponding magnetic knife holder, a projection is formed above the circular hole of the locking block, a spring is supported between the rear end of the corresponding locking block and the magnetic knife holder, two slope lugs are respectively formed on top of inner sides of the base and the upper cover, when each push button is pushed to a foremost end of the corresponding groove, each slope lug resists against the projection of the corresponding locking block, and the locking block rotates upward against the spring, so that the flange is separated from the at least one gap of the corresponding blade.

2. The utility knife of claim 1, wherein a spare knife holder for holding spare blades is disposed inside a rear section of the housing, the spare knife holder has a front portion, a rear portion and a bottom, two columns are formed on two side surfaces of the front portion of the spare knife holder, one column on each side surface, one elastic buckle is formed on each side surface of the rear portion of the spare knife holder, a bottom of a rear portion of the housing is provided with an arc openings, the inner wall of the housing is provided with two connecting holes for receiving the two columns, two positioning recesses for receiving the two elastic buckles, the spare knife holder is rotatably disposed inside the rear portion of the housing and is capable of rotating out from the bottom of the housing.

3. The utility knife of claim 2, wherein the spare knife holder is made from plastic, the bottom of the spare knife holder has an arc-shape for engaging the housing, a spare blade groove and a elastic buckle for fixing the spare blades are disposed inside the spare knife holder, bottoms of rear portions of the base and the upper cover are respectively formed with an arc opening, a top end of each elastic buckle has an arc projection for matching the corresponding arc opening, the arc projections are inserted into the corresponding arc opening of the base and the upper cover by size fitting, and the positioning recesses of the base and the upper cover respectively receives the corresponding elastic buckle and the elastic buckles are positioned.

4. The utility knife of claim 1, wherein a connecting column with an inner hole is formed a center of the inner wall of the housing, a corresponding through hole is provided on a rear portion of the knife holder gasket, and a corresponding sink hole is provided on the upper cover, the through hole of the knife holder gasket is sleeved on the connecting column, a connecting screw passes through the sink hole of the upper cover and screws into an inner hole of the connecting column of the base to connect the upper cover, the knife holder gasket and the base.

5. The utility knife of claim 1, wherein the base has a tail end, a small connecting column is provided on a bottom of the tail end of the base, the upper cover has a tail end, a small sink hole is provided on the tail end of the upper cover, the small connecting column and the small sink hole is connected with a screw, a hanging hole for hanging the utility knife is formed on a top of a tail end of the housing when the base and the upper cover are mounted together.

6. The utility knife of claim 1, wherein there are three to four recesses, which are respectively located along the top of the inner walls of the base and the upper cover, that is, the two inner side walls of the strip-shaped aperture.

7. The utility knife of claim 1, wherein the bottom of the knife holder gasket is provided with an elastic strap with a clamp matching with the knife holders.

* * * * *